United States Patent [19]

Lukac et al.

[11] 4,160,677

[45] Jul. 10, 1979

[54] METHOD OF PROCESSING ALLOY STEEL STRIP

[75] Inventors: Frederick S. Lukac, New Kensington; William P. Zbryski, Tarentum, both of Pa.

[73] Assignee: Allegheny Ludlum Industries, Inc., Pittsburgh, Pa.

[21] Appl. No.: 881,967

[22] Filed: Feb. 27, 1978

Related U.S. Application Data

[62] Division of Ser. No. 769,497, Feb. 17, 1977, Pat. No. 4,119,109.

[51] Int. Cl.[2] ..... B08B 7/04

[52] U.S. Cl. ..... 134/9; 134/15; 134/26; 134/28; 148/156

[58] Field of Search ..... 134/64 R, 83, 122 R, 134/141, 183, 194, 9, 15, 26, 28; 226/113, 118, 199, 200, 91, 92; 148/156; 242/58.1

[56] References Cited

U.S. PATENT DOCUMENTS

| | | | |
|---|---|---|---|
| 2,317,014 | 4/1943 | Yochem | 134/194 UX |
| 2,649,099 | 8/1953 | Huff | 134/64 R |
| 2,864,106 | 12/1958 | Muddiman | 134/122 R X |
| 3,087,505 | 4/1963 | Laine | 134/122 R X |
| 3,166,266 | 1/1965 | Erskine | 242/58.1 X |
| 3,565,311 | 2/1971 | Mitchell | 226/199 |

*Primary Examiner*—Marc L. Caroff

*Attorney, Agent, or Firm*—Vincent G. Gioia; Robert F. Dropkin

[57] ABSTRACT

In treating certain types of steel strip, it passes through a plurality of processes including a salt bath having a driven sink roll therein. In order to by-pass the salt bath the sink roll and its drive are raised while maintaining them horizontal. This permits changing from one type of strip which is subjected to the salt bath to another type of strip which is not subjected to the salt bath without rethreading the entire line. A guide roll at the exit end of the salt bath tank is below and out of contact with the strip which has been in the salt bath, but is raised into contact with strip which by-passes the salt bath. The guide roll is covered in its lower position and uncovered in its upper position.

1 Claim, 8 Drawing Figures

METHOD OF PROCESSING ALLOY STEEL STRIP

This is a division of application Ser. No. 769,497 filed Feb. 17, 1977, now U.S. Pat. No. 4,119,109.

This invention relates to a method processing strip and more particularly to treating alloy steel strip such as various types of stainless steel by passing the strip successively through an annealing line, a molten salt bath, a rinse, and an acid pickling solution. Some types of steel require the salt treatment while others do not. It has generally been necessary to stop the line and rethread it when changing from strip which requires the salt treatment to strip which does not, particularly when a driven sink roll is used in the salt bath. This is expensive and time consuming. By providing means for raising and lowering the driven sink roll and its drive we are able to make the above change without rethreading the line. While apparatus is known for raising and lowering idler rolls we do not know of any apparatus for raising and lowering driven rolls where the problems involved are such as to require that the drive and the roll be kept substantially horizontal at all times. A guide roll is provided at the exit end of the salt bath tank which is movable from a lower position out of contact with the strip which has passed through the salt bath to an upper position in contact with strip which bypasses the salt bath. Salt dripping from the strip builds up on the surface of the guide roll so that the strip contact surface is not smooth and cylindrical. If not removed, this build up causes damage to the strip which sometimes requires scrapping of the strip.

It is therefore an object of our invention to provide a method of treating alloy steel strip of various types in which the salt bath may be alternatively used and not used without requiring rethreading of the line.

This and other objects will be more apparent after referring to the following specification and drawings in which.

Figure 1:
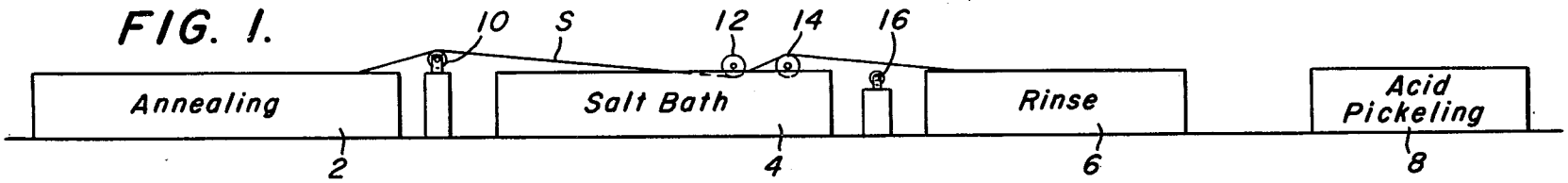
FIG. 1 is a schematic view of a strip processing line.
Figure 2:
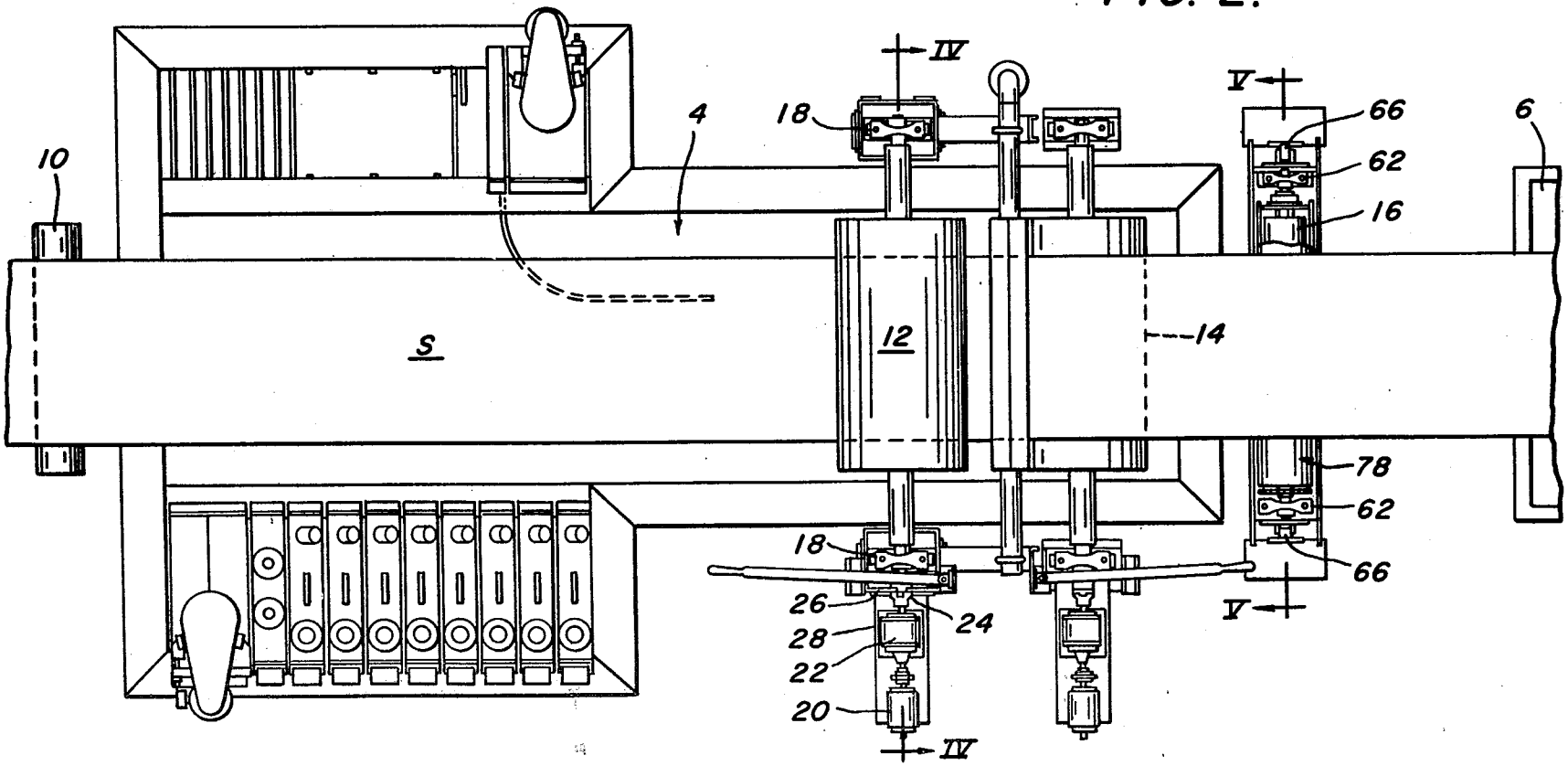
FIG. 2 is a schematic top plan view of the salt bath of our invention.
Figure 3:
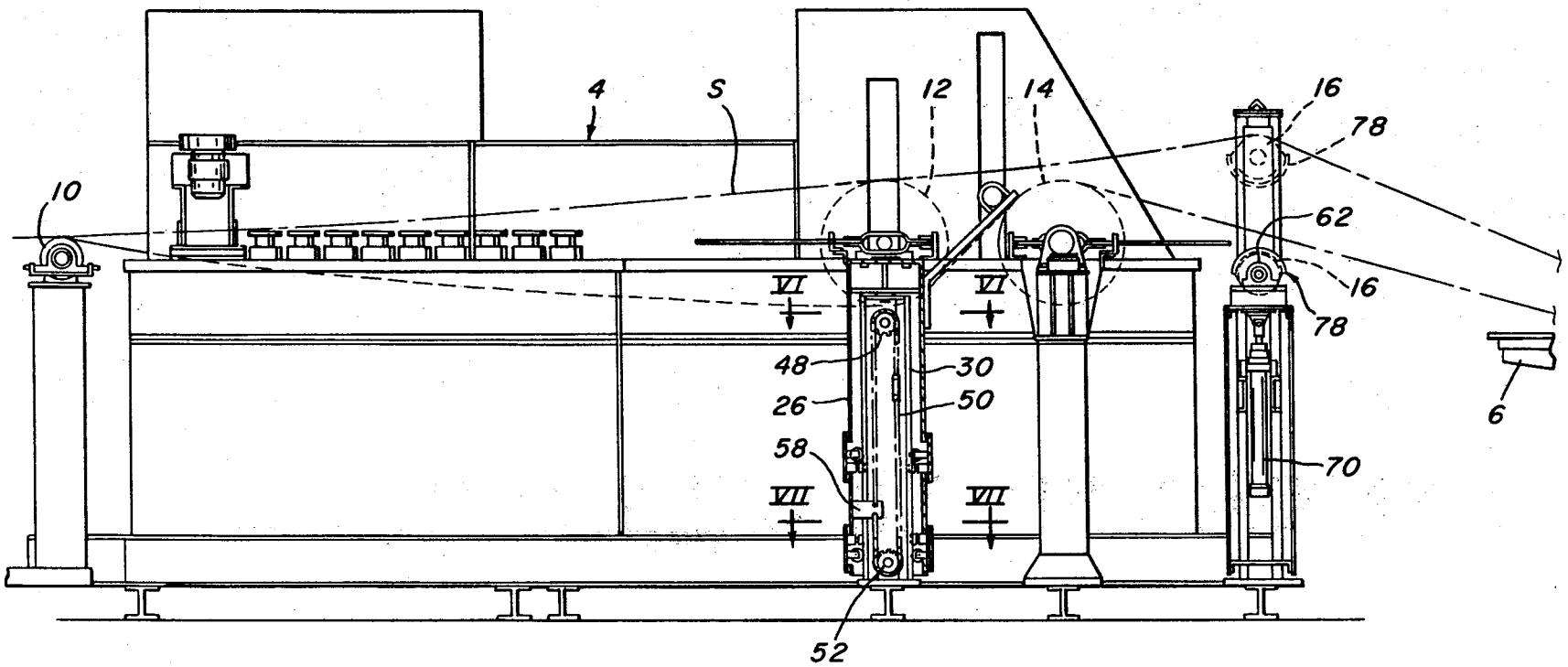
FIG. 3 is a schematic side elevation of FIG. 2.
Figure 4:
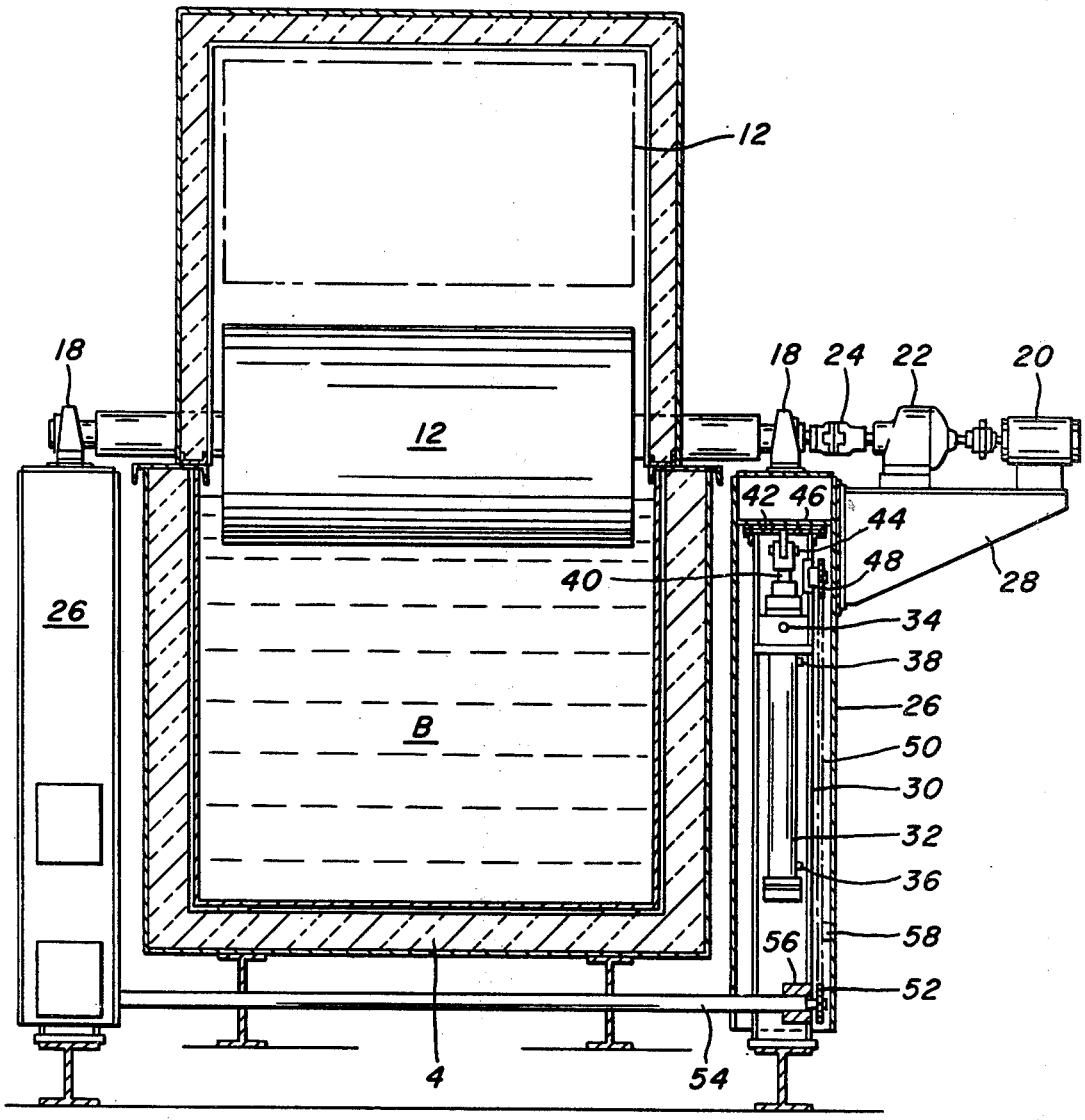
FIG. 4 is a view taken on the line IV—IV of FIG. 2.

Referring more particularly to FIG. 1 of the drawings reference numerals 2, 4, 6 and 8 indicate a strip annealing line, a molten salt cleaning bath tank, a water rinse tank and an acid pickling tank, respectively. These form a continuous strip processing line through which strip S passes continuously over or around a plurality of rolls, only some of which are shown. Our invention is directed particularly to the arrangement of rolls 10, 12, 14 and 16 which are in and adjacent the tank 4. When the strip S is directed through the salt bath it passes around the bottom of roll 12 and then exits around the top of roll 14 before passing into tank 6 in spaced relationship above roll 16. During this operation, salt is carried from the tank 4 on strip S and drips from the bottom of the strip as it passes to the rinse tank 6. Over a period of time this salt builds up on top of roll 16. It is desired to bypass the tank 4 when the material of the strip is such that it is not necessary or desirable to subject it to the salt bath. When this is done rolls 12 and 16 are raised and the strip passes directly from roll 10 at the entry end of tank 4 to roll 16.

The roll 12 is a driven roll and our invention includes means for raising the roll and its drive. The roll 12 is mounted in bearings 18, which are preferably self-aligning, and are driven by motor 20, through reducer 22 and coupling 24. The bearings 18 are each mounted on a vertically movable outer support box 26 (See FIGS. 3, 4, 6, 7 & 8). A bracket 28 attached to the right side box 26 carries the motor 20 and reducer 22. The means for raising and lowering the boxes 26 are identical so that only one will be described in detail. Inside box 26 is a fixed inner box 30 which supports a fluid cylinder 32 by means of trunions or pivoted supports 34 at its upper end. Fluid connections 36 and 38 are provided at the bottom and top of cylinder 32. Piston rod 40 extends upwardly from cylinder 32 and is connected to a plate 42 at its upper end by means of a pivoted connection 44. The plate 42 bears against a plate 46 connected horizontally to the inside of box 26. A sprocket 48 is rotatably supported on box 30 adjacent the top thereof and is connected by means of chain 50 to a sprocket 52 mounted on a horizontal shaft 54 which is rotatably supported in bearings 56 secured to the lower end of each box 30. Thus the bottom sprockets are connected for rotation together. A bracket 58 is secured to outer box 26 and to the chain 50. Thus when fluid is supplied to the bottom of cylinders 32 through lower connections 36 the two outer boxes must raise the same amount, thus keeping the roll 12 and its drive horizontal at all times so as to prevent damage thereto. This is also true when the outer boxes are lowered by supplying fluid to the top of the cylinders.

Figure 5:
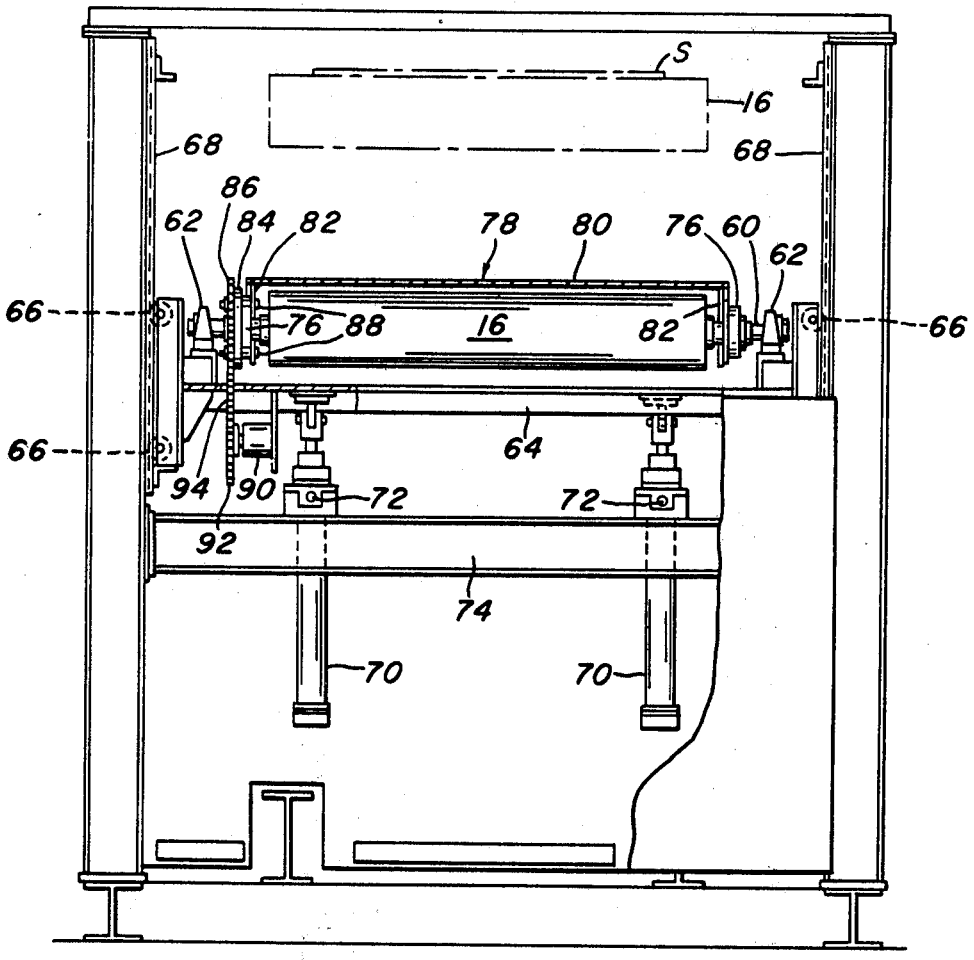
FIG. 5 is a view taken on the line V—V of FIG. 2.
Figure 8:
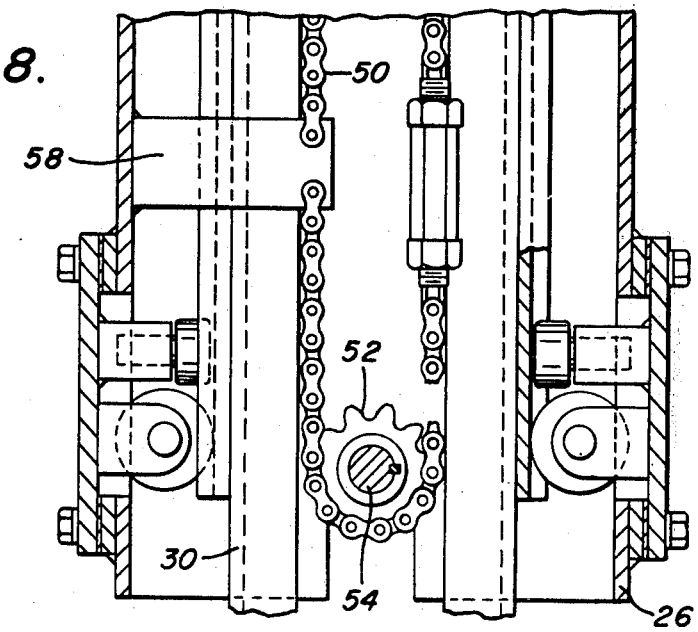
FIG. 8 is a sectional vertical view of details of FIGS. 6 & 7.
Figure 6:
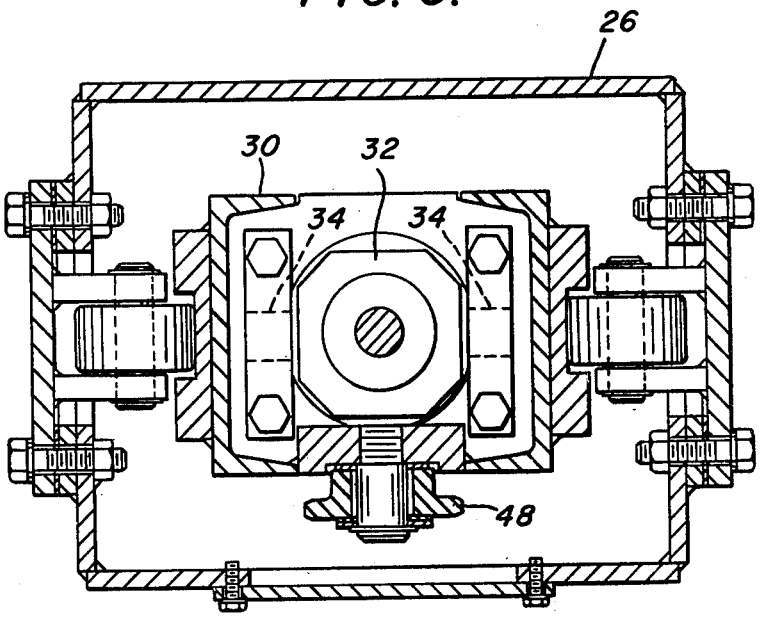
FIG. 6 is an enlarged horizontal sectional view of a detail of FIG. 4.
Figure 7:
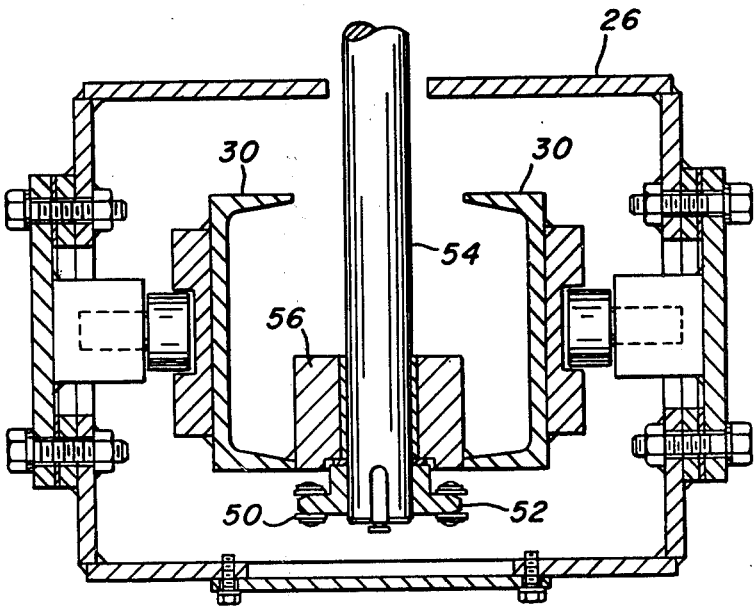
FIG. 7 is an enlarged horizontal sectional view of a detail of FIG. 4.

As best shown in FIG. 5, shaft 60 of roll 16 is rotatably supported in bearings 62 which in turn are mounted on a carriage 64 having a pair of horizontal wheels 66 at each end supported on spaced apart vertical tracks 68. Fluid cylinders 70 pivotally mounted at 72 on support 74 are attached to and raise and lower carriage 64. A bearing 76 is rotatably supported on shaft 60 between each of the bearings 62 and the roll 16. A roll cover 78 having an arcuate outer portion 80 which extends substantially around the upper half of roll 16 when the roll is in its lower position is attached to bearing 76 by means of web 82. A sprocket mounting 84 having a sprocket 86 secured thereto is mounted on one of the bearings 76. Bolts 88 extend through bearing 76, web 82, mounting 84 and sprocket 86 so that they all move together. A rotary actuator 90 is secured to carriage 64 below the roll 16 and drives a sprocket 92 which drives sprocket 86 by means of chain 94. Prior to raising the roll 16 by supplying fluid to the bottom of cylinders 70, the rotary actuator is operated to rotate the roll cover 78 through 180° so that the arcuate portion 80 surrounds the lower half of the roll 16.

In operation, with strip S passing through the strip processing line including the salt bath, the strip S will pass below roll 12 and over roll 14 above roll 16 into rinse tank 6. At this time the rolls 12 and 16 will be in their lower position with the roll cover 78 in its upper position so that any salt dripping from strip S will fall on top of its arcuate portion 80. Thus the roll 16 is kept free of salt accumulation. When strip of material which is not to be subject to the salt bath for any reason is to be processed, a coil of strip of the new material is attached to the trailing end of the strip in the processing line. After the end of the strip to be treated in the salt bath has passed through the salt bath the rolls 12 and 16 are raised and the roll cover 78 rotated through 180° with the new strip then passing below the bottom of roll 12 outside the salt bath either in contact with or out of contact with roll 12 and then around roll 16 directly into the rinse tank 6. Since the roll 16 has been kept free of salt no damage occurs to the strip as it passes over the roll. This operation is such that the line need not be rethreaded or shut down.

While one embodiment has been shown and described, it will be readily apparent to those skilled in the art that various adaptations and modifications may be made within the scope of the invention.

We claim:

1. The method of processing alloy steel strip of various types which comprises passing one length of alloy steel strip of a first type continuously through a heat treating line, then through a molten salt bath in a tank with said length passing through the molten salt bath beneath and contacting a driven sink roll positioned in said tank, then above and in spaced apart relationship with a guide roll, covering said guide roll while said strip leaving the salt bath is passing over said guide roll, then passing said length through a rinse tank, then through a pickling bath, fastening the trailing end of said one length of alloy steel strip to the leading end of another length of alloy steel strip, continuing the above steps until a last length of alloy steel of the first type is being processed and an alloy steel strip of a second type which is not to be subject to the salt bath is to be processed, then fastening the leading end of a length of the second type of alloy steel strip to the trailing end of the last length of the first type of alloy steel strip, then raising said sink roll and its drive above said salt bath so that the second type of alloy steel strip will bypass the salt bath, uncovering said guide roll and raising said guide roll to contact said second type of alloy steel strip bypassing said molten salt bath, and continuing said processing with the sink roll being in raised or lowered position according to the type of alloy steel being treated, and with said guide roll being raised and uncovered or lowered and covered according to the type of alloy steel being treated.

* * * * *